US010472813B1

(12) United States Patent
Sipaila

(10) Patent No.: US 10,472,813 B1
(45) Date of Patent: Nov. 12, 2019

(54) SUBSURFACE FLUID CONVEYANCE CHAMBER AND METHOD

(71) Applicant: Jonas Z. Sipaila, Reno, NV (US)

(72) Inventor: Jonas Z. Sipaila, Reno, NV (US)

( * ) Notice: Subject to any disclaimer, the term of this patent is extended or adjusted under 35 U.S.C. 154(b) by 0 days.

(21) Appl. No.: 16/022,473

(22) Filed: Jun. 28, 2018

Related U.S. Application Data

(60) Provisional application No. 62/525,988, filed on Jun. 28, 2017.

(51) Int. Cl.
*E03F 1/00* (2006.01)
*E02B 11/00* (2006.01)

(52) U.S. Cl.
CPC ..... *E03F 1/003* (2013.01); *E02B 11/005* (2013.01)

(58) Field of Classification Search
CPC ..... E02B 11/005; E03F 1/003
USPC ..... 405/49
See application file for complete search history.

(56) References Cited

U.S. PATENT DOCUMENTS 5,087,151 A * 2/1992 DiTullio ..... E03F 1/003 405/43
5,511,903 A * 4/1996 Nichols ..... E03F 1/003 405/36
5,588,778 A * 12/1996 Nichols ..... E03F 1/003 405/48
5,890,838 A * 4/1999 Moore, Jr. ..... E03F 1/003 405/43
5,921,711 A 7/1999 Sipaila
6,612,777 B2 * 9/2003 Maestro ..... E03F 1/003 405/46
7,118,306 B2 * 10/2006 Kruger ..... E03F 1/003 405/49
7,517,172 B2 4/2009 Sipaila
8,491,224 B2 * 7/2013 Cobb ..... E03F 1/003 405/49
9,045,873 B1 * 6/2015 Moore, Jr. ..... E02B 11/00
2004/0101369 A1 * 5/2004 DiTullio ..... E02B 11/005 405/49
2005/0238434 A1 * 10/2005 Coppes ..... E03F 1/003 405/49

* cited by examiner

*Primary Examiner* — Frederick L Lagman
(74) *Attorney, Agent, or Firm* — Kenehan & Lambertsen, Ltd.; John C. Lambertsen

(57) ABSTRACT

A subsurface fluid conveyance chamber is arch-shaped in cross-section, having a corrugated outer shell extending along a horizontal axis with a pair of contiguously molded end walls and alternating peak and valley corrugations along its length. Each peak corrugation forms an outer ridge having a top surface and a pair of sidewalls. Inner walls along each lateral side of the outer shell form interior chambers at each ridge location in the outer shell. Each interior chamber has an aperture formed in the inner wall, and two opposing apertures formed in each sidewall. The inner wall apertures are vertically offset above the outer shell apertures and form a gravity trap for the granular material, limiting entry to the lower section of the interior chambers. The angled pathways defined by the interior chamber aperture locations require directional changes in fluid flow that minimize contamination of the inner conveyance chamber during use.

12 Claims, 6 Drawing Sheets

SUBSURFACE FLUID CONVEYANCE CHAMBER AND METHOD

CROSS-REFERENCE TO RELATED APPLICATIONS

The present application claims the benefit of priority under 35 USC § 119(e) to U.S. Provisional Application No. 62/525,988 filed on Jun. 28, 2017, which is incorporated by reference herein for all that it contains.

BACKGROUND

Field of the Invention

The present invention relates to conveyance chambers for receiving, filtering, dispersing, and conveying fluids, including water, gas, and wastewater, when buried below ground or immersed in granular media. More specifically, the present invention relates to such pre-molded conveyance chambers as are corrugated and arch-shaped in cross-section with contiguously molded end walls having openings for inter-chamber fluid communication and a plurality of lateral interior chambers, each having vertically and laterally offset inside and outside fluid communication openings.

Description of the Related Art

Using above-ground watering systems, particularly in dry climates such as the southwestern regions of the United States, the Mediterranean regions of Europe, the Middle East, and in Africa, brings with it a list of known problems. Besides water loss through evaporation during the watering process, if watering is offered too lightly, shallow plant rooting results. Repeated surface applications of water produce the buildup of mineral salts, which are detrimental to healthy plant growth.

As increasing population pressures result in greater demands on freshwater supplies, the benefits of underground irrigation have become increasingly attractive. Such systems place water directly into the plant root zone and eliminate evaporative water losses. Their protected location also minimizes the risk of physical damage from surface activities.

In the same light, conventional subterranean drainage pipes of perforated holes or longitudinal slots, with or without geo-fabric coverings, are inherently problematic. Their useful life is typically short, due to internal blockage of pipe interior by direct intrusion and accumulation of sand or soil particles, or external blockage by soil infiltration of particles (also termed "convergence") on geo-fabric surfaces, impairing water movement into the drainage pipe.

The subsurface fluid distribution system described in my earlier patents, Sipaila, U.S. Pat. Nos. 5,921,711, and 7,517,172 provide a subterranean fluid distribution system with reserve fluid storage capacity to maintain soil dampness and replace water taken up by plants. As used in a passive subsurface irrigation system, capillary physics and gravity are relied upon to deliver water and nutrients to plants through interconnected chambers and pans. Such systems can reduce the irrigation water needed by 50%-80% over the more traditional above-ground systems.

These earlier chambers have sloped sidewalls that extend to a curved, arched top. When installed, such extended-arch chambers must resist both top and side loadings. The slots in the sidewalls allow the transport of water from within but act to weaken the sidewall structure. Also, although vertically offset, the sidewall apertures of the earlier chambers are vulnerable to direct pressure movements of soil particles and the associated impairment of water movements into and out of the chamber.

Thickening the sidewall would give added strength—at the cost of increased in material feedstock and an increase in chamber weight. The feedstock is entirely petrochemical, and over the past several years, those costs have been highly variable and difficult to forecast.

The added chamber weight increases the cost to transport the chambers to the installation site. Also, their efficient transport requires stacking of the chambers. The heavier chambers on top subject the chambers that are lower in the stack to an increased risk of having their sidewalls forced out. These outward, flattening forces weaken the arch-shaped chamber structure and its ability to resist overburden pressure forces after installation.

BRIEF SUMMARY

The present invention provides a pre-molded conveyance chamber of lower profile, reducing material costs and chamber weight, yet obtains enhanced resistance to overburden pressure forces through a Cathedral Arch-shaped cross-section. The conveyance chamber includes a pair of contiguously molded opposing end walls and alternating peak and valley corrugations along its length. Fluid communication between the exterior and interior of the conveyance chamber occurs through interior chambers formed at the base of the chamber at each peak ridge.

Fluid flows into each interior chamber through a pair of outer wall apertures formed in opposing sidewalls near the chamber base and through a single, enlarged inner chamber wall aperture. The inner chamber wall aperture is positioned vertically higher on the inner wall than are the opposed pair of outer wall apertures formed in the outer wall. And the flow axes of the inner and outer openings lie at ninety degrees regarding one another. These vertical and angular offsets minimize soil pressure forces directed toward the interior of the chamber.

The inner wall opening is also larger than the combined opening area of the two outer wall openings. The size differential between the inner wall and two outer wall openings resists conversion blockage.

In addition to its use in a passive subsurface irrigation system, delivering water and nutrients to plants through an interconnected series of chambers and pans, the present invention is also suitable for stormwater management. Rainwater from hard surfaces, such as roofs, parking lots, and roadways, uses a subsurface arrangement of the present conveyance chambers to obtain filtration, collection, storage, and then reuse for beneficial purposes—thus providing a dependable new water source for communities.

One aspect of the embodiments disclosed herein is a subsurface fluid conveyance chamber comprising: a corrugated outer shell extending along a horizontal axis in a manner defining alternating peak corrugations and valley corrugations, the corrugated outer shell having an arch-shaped cross-section with a pair of opposed lateral end walls formed therein and no floor, wherein the end walls and adjacent peak corrugations define a pair of terminal arches, and wherein except for the pair of terminal arches, each peak corrugation defines a ridge having a top surface and a pair of sidewalls, the top surface extending between the pair of sidewalls. A pair of inner walls, each of the pair of inner walls attached to and extending along a separate lateral interior wall of the corrugated outer shell and each of the pair of inner walls extending from a location of attachment to the interior wall to a base of the fluid conveyance chamber in a manner inwardly spaced from the corrugated outer shell to define a plurality of interior chambers, each of the interior chambers at a location within a separate inner valley corresponding to one of the alternating peak corrugations formed in the corrugated outer shell, wherein each of the plurality of interior chambers has an inner wall aperture formed in the inner wall and, except for the pair of terminal arches, each of the plurality of interior chambers includes one of the pair of sidewalls, and each of the pair of sidewalls has a sidewall aperture formed therein.

Another aspect in accordance with the embodiments disclosed herein is a subsurface fluid conveyance chamber having an arch-shaped cross-section of double-wall construction, an outer shell of alternating peak corrugations and valley corrugations along its length and a pair of inner walls, each attached to and extending along a separate lateral interior wall of the outer shell, and a pair of opposed end walls attached to the conveyance chamber at opposite ends thereof. Each of the pair of opposing end walls having a connection pipe aperture formed therein, comprising: a plurality of interior chambers formed within the subsurface fluid conveyance chamber between the inner wall and the outer shell, each of the interior chambers at a location corresponding to a peak corrugation in the outer shell, wherein the inner wall of each interior chamber has an aperture formed therein and the outer shell of each interior chamber has a pair of opposed apertures formed therein, and wherein in each interior chamber the inner wall aperture is vertically offset from the pair of opposed apertures in the outer shell.

In certain embodiments in accordance with this aspect, a subsurface fluid conveyance chamber comprising: a corrugated outer shell extending along a horizontal axis in a manner defining alternating peak corrugations and valley corrugations, the corrugated outer shell having an arch-shaped cross-section with a pair of opposed lateral end walls formed therein and no floor, wherein the end walls and adjacent peak corrugations define a pair of terminal arches, and wherein except for the pair of terminal arches, each peak corrugation defines a ridge having a top surface and a pair of sidewalls, the top surface extending between the pair of sidewalls; and a pair of inner walls, each of the pair of inner walls attached to and extending along a separate lateral interior wall of the corrugated outer shell and each of the pair of inner walls extending from a location of attachment to the interior wall to a base of the fluid conveyance chamber in a manner inwardly spaced from the corrugated outer shell to define a plurality of interior chambers, each of the interior chambers at a location within a separate inner valley corresponding to one of the alternating peak corrugations formed in the corrugated outer shell, wherein each of the plurality of interior chambers has an inner wall aperture formed in the inner wall and, except for the pair of terminal arches, each of the plurality of interior chambers includes one of the pair of sidewalls, and each of the pair of sidewalls has a sidewall aperture formed therein, wherein the inner wall apertures are vertically offset from the sidewall apertures, and wherein the sidewall apertures are at a vertical location that is lower than the inner wall apertures.

These and other objects, aspects, and features of the present invention will be better understood from the following description of embodiments when read in conjunction with the appended drawing figures.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

The preceding aspects and other aspects of this disclosure are described in detail below in connection with the accompanying drawing figures in which.

DETAILED DESCRIPTION

A subsurface fluid conveyance chamber is disclosed in the attached drawings and is described below. The embodiments are disclosed for illustration of the subsurface fluid conveyance chamber and a manner of making use of such fluid conveyance chamber and are not limiting except as defined in the appended claims.

Figures 1, 2:
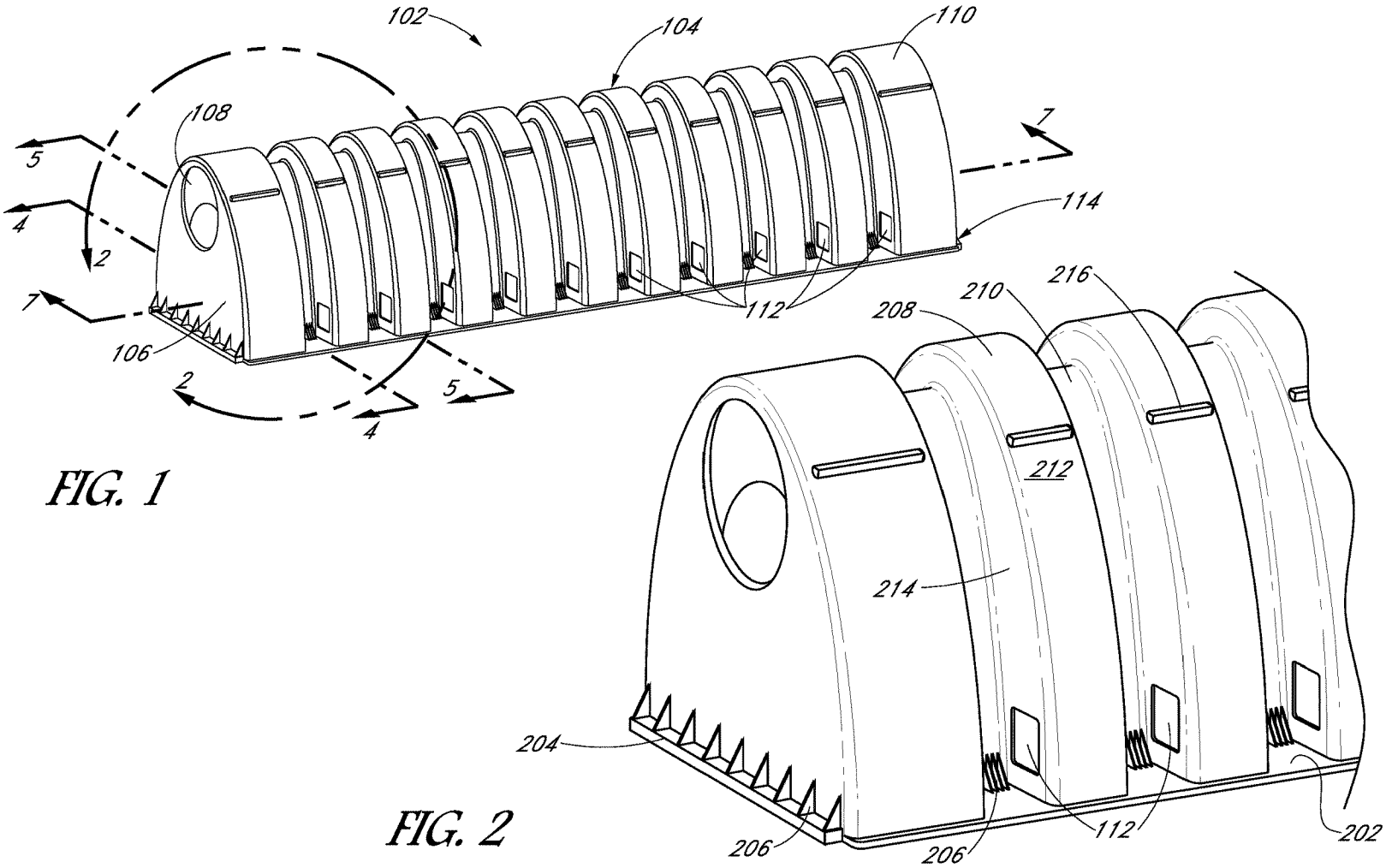
FIG. 1 is a perspective view of a subsurface fluid conveyance chamber in accordance with the present invention.
FIG. 2 is a partial, enlarged perspective view of the subsurface fluid conveyance chamber of FIG. 1.

Reference is now made to the drawings wherein like structures refer to like parts throughout. In FIG. 1 a subsurface fluid conveyance chamber 102 is arch-shaped in cross-section, with a length of corrugated outer shell 104 that extends along a horizontal axis between a pair of integrally-formed end walls 106 at opposite ends of the conveyance chamber and no floor. A connecting pipe aperture 108 is formed at a central location in both end walls. The aperture is sized to receive a connector pipe 916 (shown in phantom in FIG. 9) that is used to transfer fluid into or out of the conveyance chamber, as well as to connect adjacent chambers. Commonly of 2-inch PVC or ABS pipe, identified as 2-inch SCH40, with an exact outside diameter of 2.375 inches, the connector pipe can extend upwards of 20 feet.

A terminal arch 110 is located at each end of the conveyance chamber and has a greater width than the remaining arches. This increased width offers a longer connecting pipe insert distance. The valley/groove next to the terminal arch on both ends of the chamber extends below the level of the top arch of the connecting pipe aperture, forming a stop wall that blocks the further insertion of connecting pipe into the conveyance chamber. As also shown in FIG. 1, both lateral sides of the conveyance chamber include a plurality of sidewall apertures 112, located adjacent a base 114 thereof.

A support footing 202 gives structural support for the conveyance chamber and extends laterally along the base 114 at both sides of the corrugated outer shell. The support footing offers a stable support base for the conveyance chamber, as it is positioned for an irrigation or drainage system. The support footings also cooperate to form a stable array when the chambers are stacked for transport. A footing flange 204 attached and extending from the base edge of both end walls gives added support.

A plurality of triangular braces 206 extend along both the support footing and the footing flange, giving lateral rigidity to footing/vertical wall connection. The triangular braces may be fabricated as part of the extrusion process used to form the end walls and corrugated outer shell of the conveyance chamber.

Referring to FIGS. 1 and 2, the corrugated outer shell shows a repeating outer pattern of peak corrugations 208 and valley corrugations 210, also referred to herein as ridges and grooves. Each peak corrugation or ridge includes a top surface 214 that lies intermediate a pair of sidewalls 214. Each of the pair of sidewalls has a sidewall aperture formed therein.

Transport stacking efficiencies are obtained through a plurality of stacking ledges 216 formed on and outwardly projecting laterally along each ridge of the corrugated outer shell on both sides of the conveyance chamber. The stacking ridges are positioned in a manner providing a receiving surface or base for the support footing upon vertically stacking a plurality of conveyance chambers.

Figure 3:
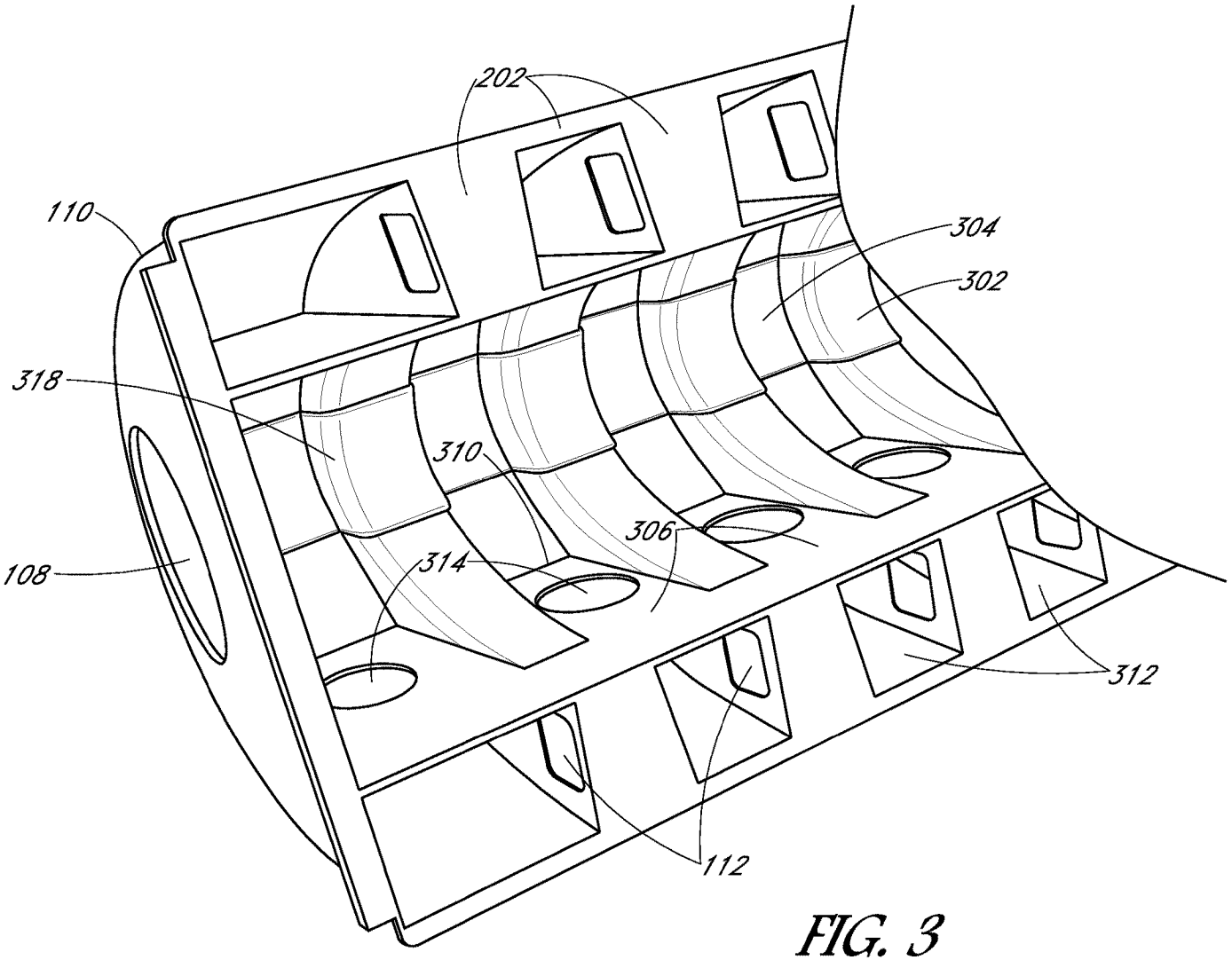
FIG. 3 is a partial, enlarged perspective view, taken from below, of the subsurface fluid conveyance chamber of FIG. 1.
Figure 6:
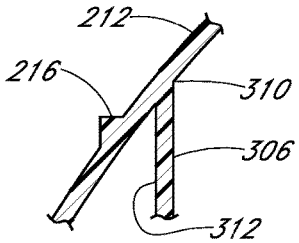
FIG. 6 is an enlarged cross-sectional view of the top surface of the outer ridge, the inner wall, the fused attachment seam, and the stacking ledge taken along the encircled area 6-6 of FIG. 5.

From a perspective within the conveyance chamber, shown in FIG. 3, the outer peaks and valleys inversely correspond to inner peaks 302 and inner valleys 304 inside of the conveyance chamber. The conveyance chamber is of double-wall construction with an inner wall 306 is formed within each interior valley and vertically extends, inwardly spaced from the corrugated outer shell, from the support footing 202 to a fused attachment seam 310 forming a location of attachment in the outer shell at a ridge location. As so attached, the inner wall forms a plurality of interior chambers 312 within and extend along both longitudinal sides of the conveyance chamber, their location corresponding to each peak/ridge location in the outer shell. The cross-sectional view of FIG. 6 shows both the fused attachment seam/location of attachment connecting the inner wall to the inside surface of the outer ridge. Also shown in FIG. 6 is the stacking ledge formed in the top surface of the outer ridge.

A single inner wall aperture 314 is formed in the inner wall of each interior chamber, and two outer shell apertures are formed in the peak/ridge outer shell corrugation—in the sidewalls at the base of the chamber. The outer shell apertures are positioned opposite one another, and as so positioned, each of the fluid flow axes of the two outer shell apertures is 90 degrees offset from the fluid flow axis of the inner wall aperture. As depicted in the figures, the inner wall aperture is preferably oval, to better equalize the fluid flow area into and out of the central chamber with the flow area of the two opposed outer shell apertures.

Most hydraulic applications for the conveyance chamber rely upon multiple connected conveyance chambers. Discrete connecting pipes connect adjoining conveyance chambers. A separate pipe end extends into each adjoining chamber through the connecting pipe apertures formed in the chamber end walls. All these applications need continuous fluid communication between adjoining chambers. Separation of a connecting pipe from an end wall aperture ruptures such fluid communication and would degrade, if not destroy, operational efficiency.

The terminal arch at each end of the conveyance chamber has a greater width than the remaining arches. This increased width offers a longer connecting pipe insert distance. The valley/groove next to the terminal arch on both ends of the chamber forms an inner arch abutment surface 318 at the apex of the arch-shaped cross-section and extends below the level of the top arch of the connecting pipe aperture. The abutment surface or a stop wall cooperatively engages with the terminus of a connecting pipe and blocks the further insertion of the connecting pipe into the conveyance chamber.

This feature assists in the proper installation of the connecting pipes. Once in operation, longitudinal pipe movement—in either direction, could result in the dislodgement of the connecting pipe from one or the other of the adjoining leaching chambers. This break in fluid communication is likely to severely impair the operational efficiency of the application, at least on that series of connected chambers.

The distance between the adjacent, connected conveyance chambers can be as short as a few inches or as long as twenty feet, depending upon the application. Nominal separation in typical athletic fields is about one foot between the conveyance chamber end walls. Regardless of total connection pipe length, the stop wall limits longitudinal pipe end movement within both chambers to an amount insufficient to result in connecting pipe dislodgment from either chamber.

Figure 4:
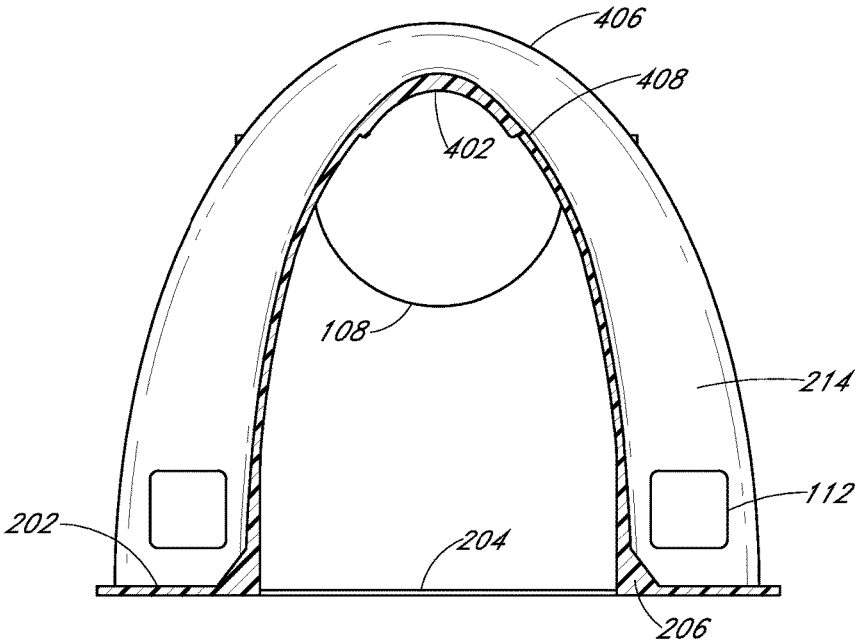
FIG. 4 is a cross-sectional elevation view of the valley corrugations of the subsurface fluid conveyance chamber of FIG. 1 taken along line 4-4 in FIG. 1.

FIG. 4 illustrates an arch-shaped cross-section of valley or groove corrugations, having a downwardly projecting inner arch 402 formed in the inner peak inside of the chamber, which is the inside surface of the outer groove formed in the corrugated outer shell, and of the lowered profile of the inner arch, effectively blocking the upper circumference of the connecting pipe aperture. The inner arch thus also effectively blocks the further insertion of a connecting pipe into the interior of the chamber through the connecting pipe aperture.

Figure 5:
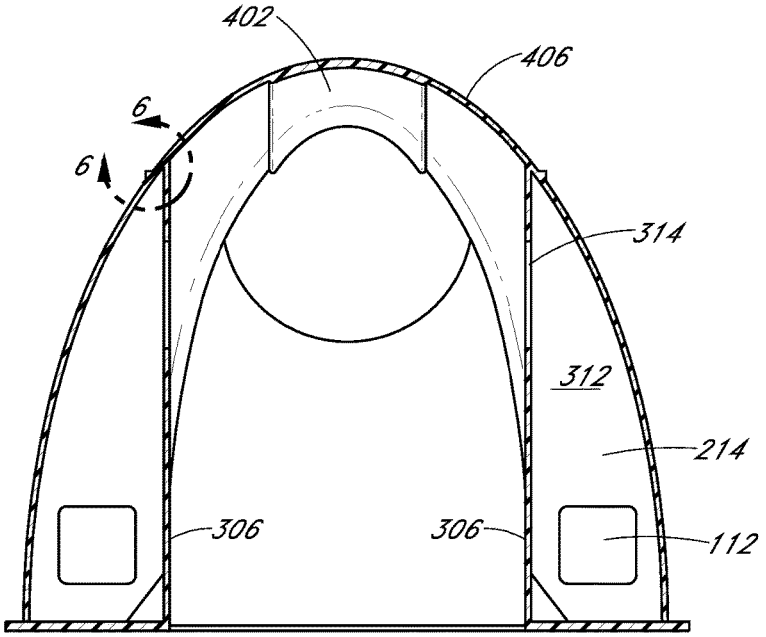
FIG. 5 is a cross-sectional elevation view of the peak corrugations of the subsurface fluid conveyance chamber of FIG. 1 taken along line 5-5 of FIG. 1.

FIG. 4 also illustrates the manner in which the sidewall aperture is formed in the sidewall of the outer ridge, and its location adjacent to the support footing. FIG. 5, which illustrates an arch-shaped cross-section of peak or ridge corrugations, illustrates the formation of the other sidewall aperture formed in the other, opposing sidewall of the outer ridge.

Figure 7:
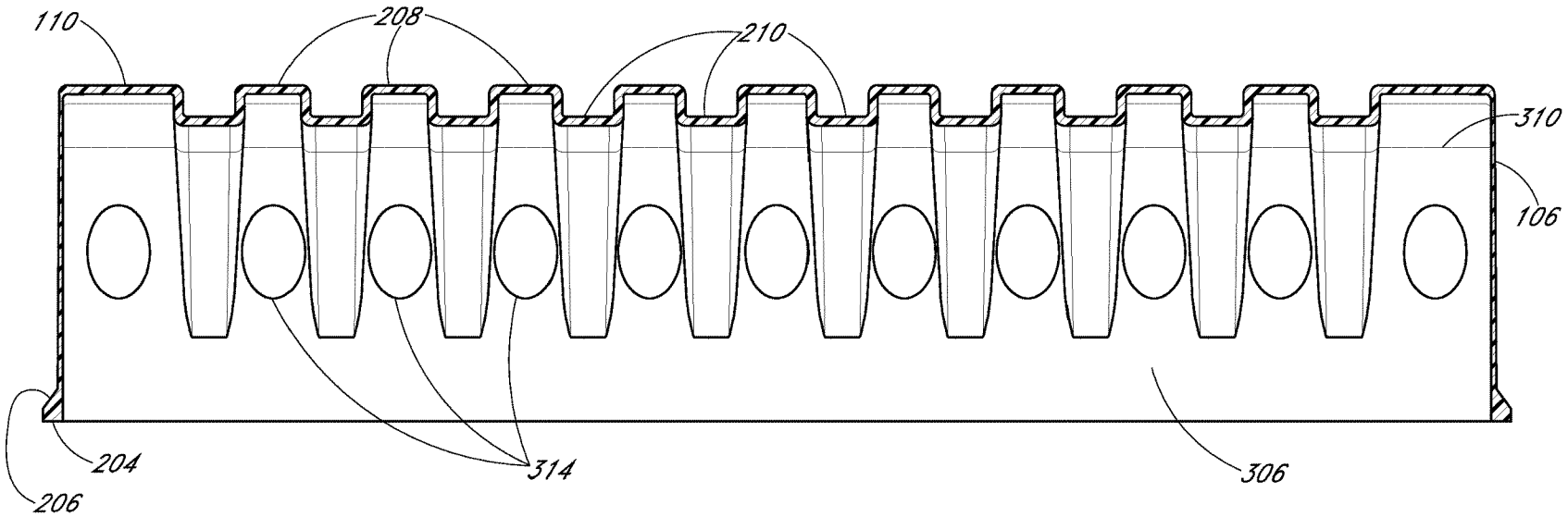
FIG. 7 is a cross-sectional view of the subsurface fluid conveyance chamber of FIG. 1 taken along line 7-7 of FIG. 1.

The manner in which the outer ridge and groove corrugations interface with the inner wall is shown in FIG. 7. Except at the ends, where the terminal arches are of greater width, the remaining corrugations provide regular alternating interior chambers marked by oval-shaped inner wall apertures and inner peaks projecting out from the inner wall as they extend toward the top of the chamber, which identify the locations of valley corrugations in the outer shell.

Figure 8:
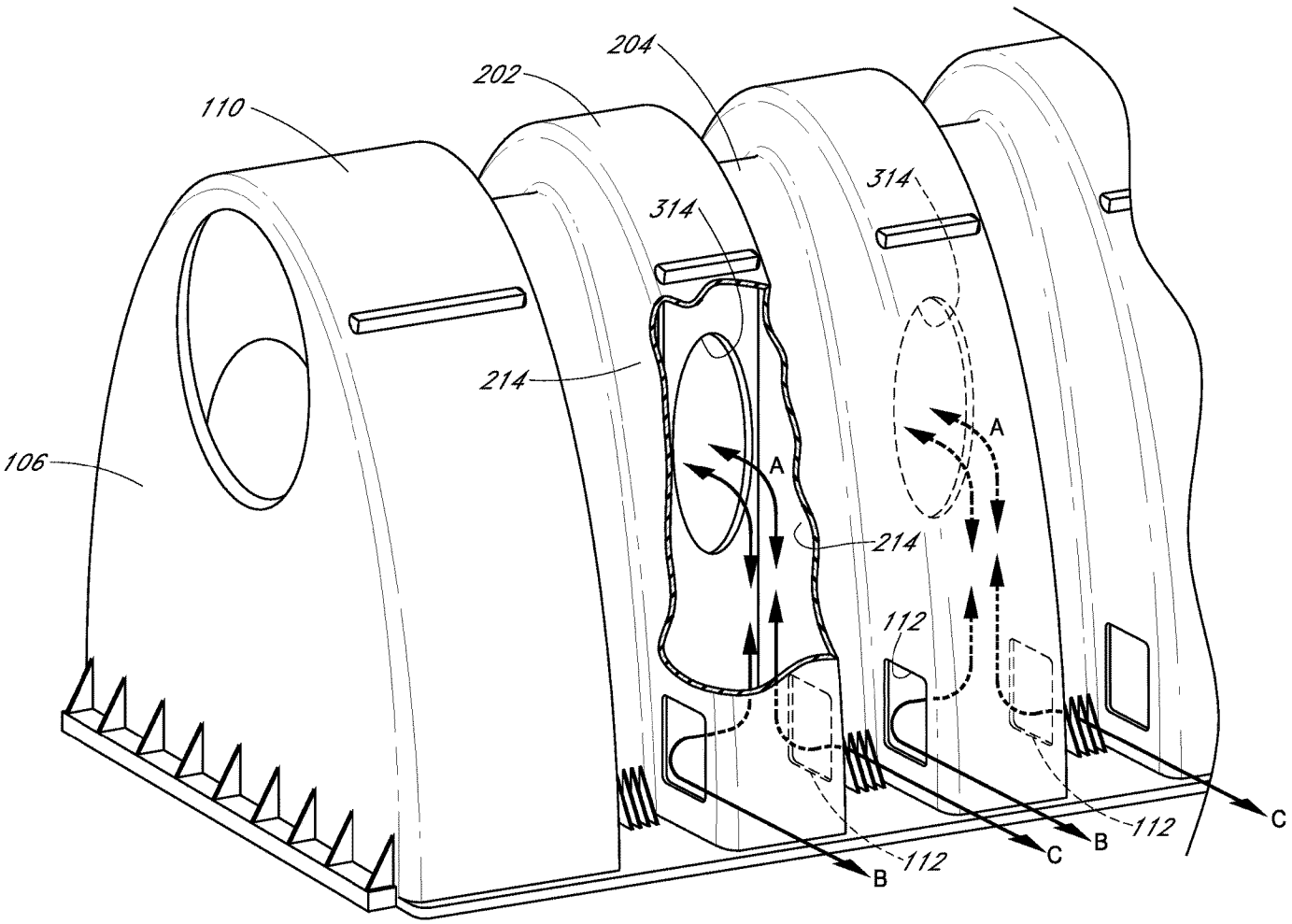
FIG. 8 is a partial, enlarged perspective view of the subsurface fluid conveyance chamber of FIG. 1, similar to FIG. 2, with portions broken away and portions shown in phantom, illustrating the fluid flows into and out from the subsurface fluid conveyance chamber of the present invention.

In a presently preferred embodiment, the oval-shaped inner wall apertures of each interior chamber are vertically offset above the two outer sidewall apertures, which is depicted in FIG. 8. Since the large outer openings intentionally allow smaller granular material to enter the outer chamber, the offset prevents granular material movement into the primary chamber. This vertical positioning arrangement employs gravity to impair the fouling flow of outside particulate matter into the primary chamber. As depicted by flow arrows A, the particulates must flow up through the interior chamber to reach the inner wall apertures and only then gain entry to the main chamber.

A further restraint against fouling is obtained with the above-mentioned angularly offset (preferably 90-degree offset) in directional flow as between the outer shell apertures and the oval inner wall aperture. The change in fluid flow path direction depicted by flow path arrows A, B, and C acts to resist the upward movement of granular material induced by surrounding soil pressure. Those flows, if successful in placing granular material in the main chamber cavity, would also foul the conveyance chamber.

The conveyance chamber of the present invention has a lower profile than the earlier leaching chambers. The conveyance chamber has a preferred height of 5.5 inches and a width of 6.25 inches, as compared to the earlier chambers with measurements of 6.3 inches and 13.25 inches, respectively.

The presently preferred length of the conveyance chamber is 24 inches. These smaller dimensions and height/width profile obtain manufacturing and installation cost advantages. Less material needed for construction reduces the cost of the conveyance chamber, and the lighter-in-weight manufactured chamber reduces transportation costs. The height reduction enables placement of the conveyance chamber at a shallower depth and with less fill—both lowering installation costs.

These cost advantages are obtained while avoiding problems previously discussed with proposed modifications to prior chamber designs. As shown in the chamber profiles of FIGS. 4 and 5, the more vertical "Cathedral Arch" of the present conveyance chamber, having the base distance (6.5 inches) close to the height distance (5.5 inches) gives a stronger structure to resist overburden pressure forces. The vertical and directional flow offsets of the interior chamber openings reduce interior chamber fouling by outer granular particles.

In a presently preferred embodiment and recognizing that other dimensions are possible—and considered within the scope of the present invention, the connecting pipe aperture formed in both end walls has a diameter of 2.375 inches. The oval inner wall aperture has a height of 1.5 inches and width of 1.0 inches, with the height and width of the two outer shell apertures of 0.75 inches.

Fabrication of the conveyance chamber is preferably by plastic extrusion, using a plastic such as High Density Polyethylene, polypropylene, or other suitable polyolefins. By positioning all the offset and connecting apertures in an injection mold cavity, the conveyance chamber of the present invention can be monolithically molded, producing the one-piece chamber with no other machining needed.

The spacing of the inner wall oval apertures are 2.5 inches apart, on center, and the multiple outer apertures are 1.0 inches apart, on center. The preferred manner of fabrication using injection molding enables inclusion of the other structural dimensions, the 4.25-inch height of the inner wall, the 1-inch width of the footing flange, the ⅜-inch triangular braces, and the 1-inch-wide support footing, in the same, single injection molding to produce a single-piece integrated chamber.

By the present invention, making use of the conveyance chambers for any of various subterranean applications first requires excavation of trenches. The reduced height and width profile of the present conveyance chambers enables the trenches to be as shallow as seven inches and as narrow as seven inches wide.

Wider and deeper trenches are at times required. In such instances, the strength obtained by the Cathedral Arch structure allows for placement of the conveyance chambers in such deeper trenches with no added supports needed. More generally, the length and width of the trenches will vary, depending upon the design requirements for the leaching bed, irrigation field, or drainage tile.

For purposes of illustration, excavation of a trench is performed following the layout necessary for an application, and in the context of such factors as the topography and hydraulic characteristics of the area of installation. Once excavated, the trench network(s) is leveled. If downward leaching of water is not desired, water impermeable liners or enclosing boxes, such as Firestone® PondGard™ EPDM liners and HDPE geomembrane liners (High Density Polyethylene), are installed in the leveled trench.

After trench formation and trench bottom preparation (as required for the particular application), one or (usually) multiple conveyance chamber(s) are placed in the trench. Orientation is preferably end-to-end, placing the lateral conveyance chamber water discharge apertures in substantial linear alignment, which provides a decanting mechanism as the water moves from chamber to chamber. An end received within the end panel openings, connector pipes extend between adjacent conveyance chambers, connecting one chamber to another, enabling fluid communications along the entire series of conveyance chambers.

A layer of sand or fine gravel (gravel of a type suitable for drainage applications) is back-filled over the connected conveyance chambers. The upward capillary draw of most sands exceeds a ten-inch vertical above the waterline, and thus a preferred depth of the fill sand over the leaching chambers is twelve inches or more from the trench bed. The present invention can make use of sands of varying coarseness, with a sand coarseness of 0.3 mm to 1.0 mm grain size being viewed as particularly appropriate for sub-irrigation purposes. Larger gravel sizes of 5 mm to 10 mm may be used as bridging layers below the sand or unilaterally as filtering media in drainage applications.

The sand layer may be optionally covered with topsoil—trace up to a depth of two inches in planting media. Because of the arched cross-section of the outer shell, the conveyance chambers are sufficiently strong to withstand the weight of vehicles driving over or parked on top of the replaced soil. The surface finish can also be permeable pavers, concrete pourings, or other impermeable coverings as desired in the industry.

No matter the care in trench excavation and site preparation, settlement is likely to occur, and occur to different extents among the settlement chambers. Such settlement of the individual leaching chambers within the trenches will not cause a break in the sand seal, as the sand also moves with the settling event. In this regard, the sand fill forms a barrier against soil intrusion into the chambers. The connector pipe/conveyance chamber relationship is self-adjusting, with the connector pipe movably received within the end wall apertures. The increased width of the terminal arches over that of the previous chamber design gives a greater margin of safety to avoid connector pipe disengagement from the end wall resulting from such self-adjusting movement between adjacent conveyance chambers.

Depending upon terrain slope, several different arrangements of conveyance chamber arrays are possible. Since the conveyance chamber units act independently throughout their (preferred) two-foot length, on sloping terrain, the trenches are preferably excavated level along the slope contours. Where the fluid conveyance application requires multiple lateral lines of conveyance chambers located on different vertical levels, inter-line connections can extend perpendicularly across the slope contours, utilizing longer connector pipes where needed.

Figure 9:
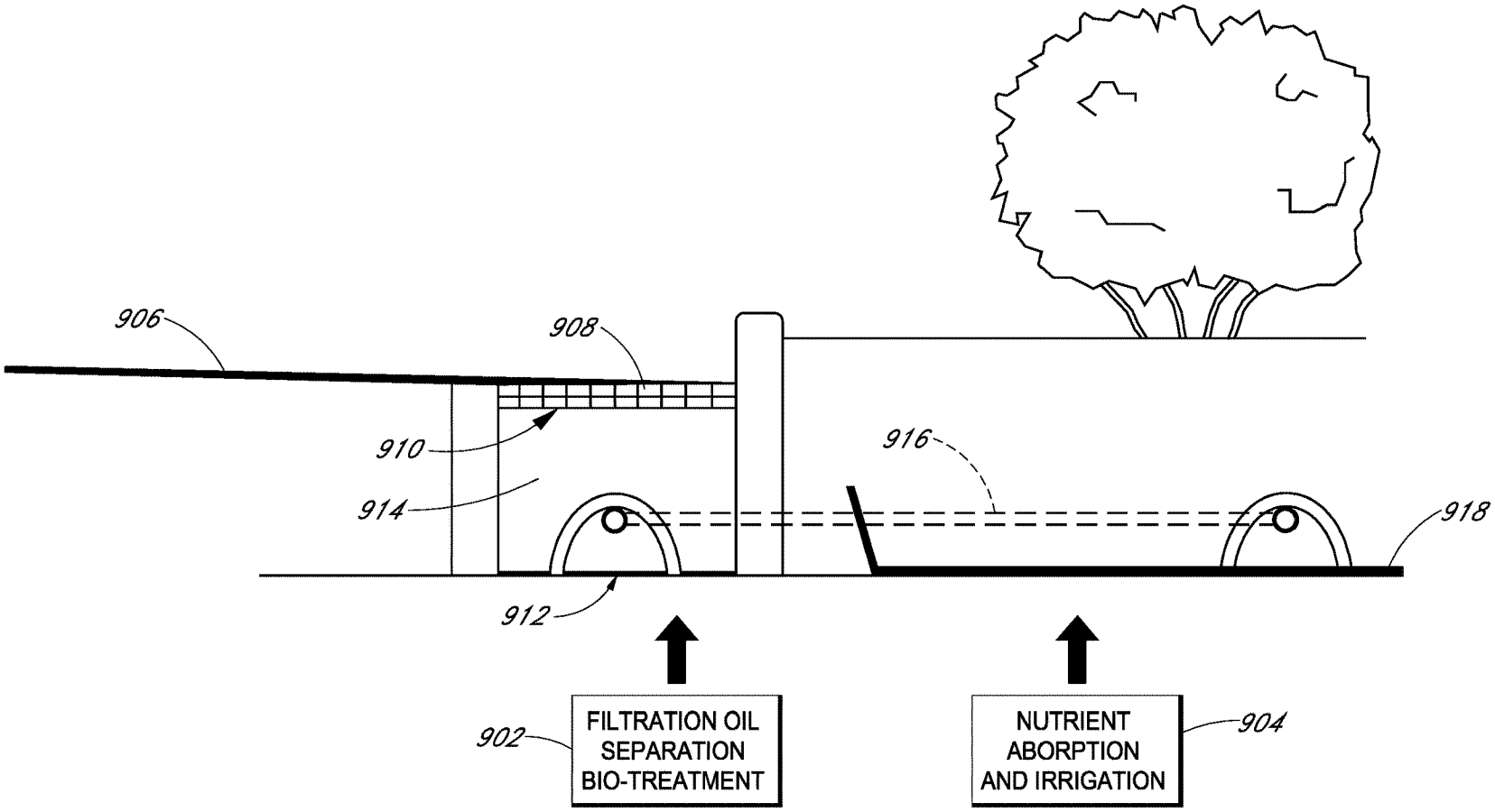
FIG. 9 is a schematic view showing use of the subsurface fluid conveyance chamber of the present invention for both filtration and subsurface irrigation.

FIG. 9 illustrates the use of the fluid conveyance chamber of the present invention in a connected application undertaking different functions. One-half of the Figure depicts a filtration method and process 902, and the second half, a nutrient absorption and irrigation method and process 904. In the filtration process, the chamber receives fluid (water) flow, and in the injection and irrigation process, fluid (water) flows out of the chamber.

In the filtration process 902 the conveyance chamber is a component used for treating, channeling, and possibly temporarily storing stormwater run-off from a road, parking lot, or similar non-porous surface. In FIG. 9 run-off from a street 906 first encounters a filtering medium for larger, non-dissolving objects, such as a removable grate or open pavers 908. In some applications, a further screening is provided underneath the initial medium, such as a removable geo-fabric or 1 mm stainless steel screen 910—both serve to protect the in-ground filtration media, extending its useful life.

The conveyance chamber is placed on top of a water impermeable liner 912, such as an EPDM liner discussed previously. The conveyance chamber is then surrounded with fine gravel 914 and placed within a contained profile that provides stormwater run-off filtration. Since infiltration flow into the gravel is quick, and the offset inner and outer chamber aperture separation creates a gravity trap without converging the gravel toward a small opening, free fluid flow into the chamber occurs, with only filtered water entering the chamber.

Open spaces between the gravel particles form a surface filter area that prevents entry into the gravel of any particle eight times smaller than the diameter of the gravel. Typical road debris is sand (1 mm) and gravel that is less than 8 mm in diameter, which will retain all sand and larger particles at the surface where it can be easily serviced. As mentioned, surfaces can also be enhanced by capping the gravel with a protected mesh or geo-fabric material that can also limit the entrance of specific particle sizes. Retained sand filtrate can then further enhance filtration by inhibiting the entry of even finer particles into the contained profile until removed.

In the nutrient absorption and irrigation process 904 the filtered water moves through a connecting pipe network 916 to a conveyance chamber placed within a water impermeable enclosing box. The conveyance chamber is surrounded by sand, and the chamber freely injects water flow into the sand profile, while the offset inner and outer aperture separation prevents fouling sand entry into the chamber itself. Capillary physics of the sand then initiates the upward movement of water through the sand voids creating an aerobic root zone profile preferred by plants, thereby achieving passive sub-irrigation. Dissolved nutrients that may be part of the filtered water and that have passed through the initial gravel interface are now injected into the root zone for further absorption and assimilation by the plants, accomplishing final treatment of the stormwater contaminants.

Use of the conveyance chamber is not limited to liquid fluids, and the manner in which the location of the apertures minimize the risks of particulate plugging are also advantageous when gaseous fluids are passed through a network. In such instances, the conveyance chamber network is formed under impermeable liners and covered with selected granular material. Such chamber network can serve as gas collection and transport, collecting decomposition gases, such as methane, in landfill operations. As methane gas moves upward through the landfill, the impermeable cap blocks further upward movement, and the accumulating methane enters the chambers, which offer it very little resistance, and then travel within the network to a collection outlet.

In another use, granular material such as grains or corn is arranged in a silo or a heap, with the conveyance chambers placed at the bottom, under the grain/corn. The conveyance chamber network is then used to inject air into the pile, through the chambers and 2-inch connectors. This conveyance of dry air into the grain (or other) matrix results in moisture removal from the matrix as air moves through the profile. The large chamber openings provide little resistance to air flow, requiring less energy to move the air. The inside/outside aperture configuration prevents grain entry into the chamber.

As various changes could be made in the above constructions without departing from the scope of the invention, it is intended that all the matter contained in the above description or shown in the accompanying drawings shall be interpreted as illustrative and not in a limiting sense.

What is claimed is:

1. A subsurface fluid conveyance chamber comprising:

a corrugated outer shell extending along a horizontal axis in a manner defining alternating peak corrugations and valley corrugations, the corrugated outer shell having an arch-shaped cross-section with a pair of opposed lateral end walls formed therein and no floor, wherein the end walls and adjacent peak corrugations define a pair of terminal arches, and wherein except for the pair of terminal arches, each peak corrugation defines a ridge having a top surface and a pair of sidewalls, the top surface extending between the pair of sidewalls; and a pair of inner walls, each of the pair of inner walls attached to and extending along a separate lateral interior wall of the corrugated outer shell and each of the pair of inner walls extending from a location of attachment to the interior wall to a base of the fluid conveyance chamber in a manner inwardly spaced from the corrugated outer shell to define a plurality of interior chambers, each of the interior chambers at a location within a separate inner valley corresponding to one of the alternating peak corrugations formed in the corrugated outer shell, wherein each of the plurality of interior chambers has an inner wall aperture formed in the inner wall and, except for the pair of terminal arches, each of the plurality of interior chambers includes one of the pair of sidewalls, and each of the pair of sidewalls has a sidewall aperture formed therein, wherein the inner wall apertures are vertically offset from the sidewall apertures, and wherein the sidewall apertures are at a vertical location that is lower than the inner wall apertures.

2. The subsurface fluid conveyance chamber of claim 1, wherein the location of the inner wall and sidewall apertures within each interior chamber define fluid flow paths that are 90-degree offset in directional flow.

3. The subsurface fluid conveyance chamber of claim 1, and further comprising a plurality of stacking ledges formed on and projecting outwardly from the top surface of a plurality of the outer ridges.

4. The subsurface fluid conveyance chamber of claim 1, wherein the pair of opposed lateral end walls each comprise a contiguously molded structure to the corrugated outer shell, each of the end walls having a connecting pipe aperture centrally formed therein.

5. The subsurface fluid conveyance chamber of claim 4, and further comprising an inner arch formed in and projecting downwardly from an interior wall of the corrugated outer shell at a location corresponding to one of the valley corrugations formed in the outer shell, the inner arch having an abutment surface formed thereon, the abutment surface adapted to cooperatively engage with a connecting pipe when the latter is selectively received within an interior of the corrugated outer shell.

6. The subsurface fluid conveyance chamber of claim 5, wherein the abutment surface is adapted to cooperatively engage with a terminus of the connecting pipe preventing further intrusion of the connecting pipe within the interior of the corrugated outer shell.

7. The subsurface fluid conveyance chamber of claim 5, wherein the abutment surface is formed in the corrugated outer shell at an apex of the arch-shaped cross-section.

8. A subsurface fluid conveyance chamber having an arch-shaped cross-section of double-wall construction, an outer shell of alternating peak corrugations and valley corrugations along its length and a pair of inner walls, each attached to and extending along a separate lateral interior wall of the outer shell, and a pair of opposed end walls attached to the conveyance chamber at opposite ends thereof, each of the pair of opposing end walls having a connection pipe aperture formed therein, comprising:

a plurality of interior chambers formed within the subsurface fluid conveyance chamber between the inner wall and the outer shell, each of the interior chambers at a location corresponding to a peak corrugation in the outer shell, wherein the inner wall of each interior chamber has an aperture formed therein and the outer shell of each interior chamber has a pair of opposed apertures formed therein, and wherein in each interior chamber the inner wall aperture is vertically offset from the pair of opposed apertures in the outer shell, wherein the pair of opposing sidewall apertures are at a vertical location that is lower than the inner wall apertures.

9. The subsurface fluid conveyance chamber of claim 8, wherein each peak corrugation defines an outer ridge having a top surface and at least one sidewall, and wherein a plurality of the outer ridges each have a pair of opposing sidewalls, with each of the pair of opposing sidewalls having one of the opposed pair of apertures in the outer shell formed therein.

10. The subsurface fluid conveyance chamber of claim 9, wherein the location of the sidewall apertures within each interior chamber defines fluid flow paths that are angularly offset from a fluid flow path within the interior chamber defined by the vertically offset inner wall aperture.

11. The subsurface fluid conveyance chamber of claim 10, and further comprising a plurality of stacking ledges formed on and projecting outwardly from the top surface of a plurality of the outer ridges.

12. The subsurface fluid conveyance chamber of claim 11, wherein the pair of opposed end walls each comprise a contiguously molded structure to the subsurface fluid conveyance chamber of arch-shaped cross-section.

* * * * *